United States Patent [19]

Takahashi et al.

[11] 4,236,923

[45] Dec. 2, 1980

[54] METHOD OF METALLURGICALLY JOINING A FITTING TO A SHAFT

[75] Inventors: Akio Takahashi, Toyota; Chiaki Tsumuki, Aichi; Hitoshi Nakamura, Toyota, all of Japan

[73] Assignee: Toyota Jidosha Kogyo Kabushiki Kaisha, Toyota, Japan

[21] Appl. No.: 960,622

[22] Filed: Nov. 14, 1978

[30] Foreign Application Priority Data

Jan. 31, 1978 [JP] Japan ..... 53-9527

[51] Int. Cl.[3] ..... B22F 3/00; B22F 7/08

[52] U.S. Cl. ..... 75/208 R; 75/200

[58] Field of Search ..... 75/200, 208 R

[56] References Cited

U.S. PATENT DOCUMENTS

| | | | |
|---|---|---|---|
| 3,753,704 | 8/1973 | Manilla et al. | 75/208 R |
| 3,761,257 | 9/1973 | Dunn | 75/200 |
| 3,791,798 | 2/1974 | Joyce et al. | 75/200 |
| 3,808,659 | 5/1974 | Alger et al. | 75/208 R |
| 3,889,349 | 6/1975 | Kaufman | 75/208 R |
| 3,962,772 | 6/1976 | Haller | 75/208 R |
| 4,090,873 | 5/1978 | Takamura et al. | 75/208 R |

*Primary Examiner*—Brooks H. Hunt

*Attorney, Agent, or Firm*—Brisebois & Kruger

[57] ABSTRACT

Method of obtaining a metallurgically firm joint between a shaft and its fitting member by assembling on the shaft a fitting member molded of a wear-resistant iron base sinterable alloy which yields a liquid phase in sintering, or by preliminarily sintering such an alloy at a temperature not yielding a liquid phase, and thereafter sintering the assembly at a temperature causing a precipitation of liquid phase, whereby the liquid phase of the fitting member is caused to diffuse and penetrate into the shaft with shrinkage of the sintered part.

14 Claims, 3 Drawing Figures

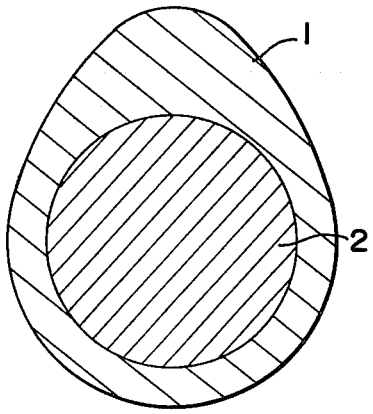
FIG. 1
FIG. 2
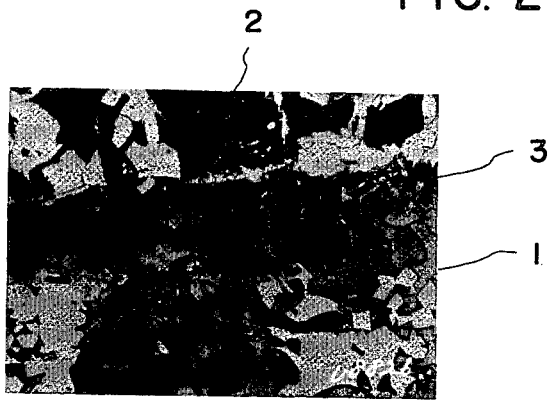

METHOD OF METALLURGICALLY JOINING A FITTING TO A SHAFT

BACKGROUND OF THE INVENTION

1. Field of the Invention

The present invention relates to a method of joining a shaft to a fitting member, i.e., a member fitted on the circumference of the shaft.

2. Description of the Prior Art

Conventionally, for the purpose of joining a shaft to its fitting member with enough strength to withstand working conditions, the shaft is first assembled to the fitting member and is then mechanically secured by brazing, welding, a screw, a key or by caulking. Such a process, however, requires a specific connecting material or device and is liable to be troublesome.

SUMMARY OF THE INVENTION

The object of the present invention is to provide a joining method which is simple as compared with the above-mentioned conventional methods, and is economical and highly reliable, assuring a high joint strength with little variance.

Another object of the present invention is to provide a joining method to obtain a metallurgically firm joint between a shaft and its fitting member by sintering to cause a liquid phase of the fitting member to diffuse and penetrate into the shaft with shrinkage of the fitting during such sintering.

Several other objects of the invention will become apparent from the following detailed description of the invention in conjunction with the attached drawings.

BRIEF DESCRIPTION OF THE ATTACHED DRAWINGS

FIG. 1 shows a radial section through a cam shaft—cam piece assembly.

FIG. 2 is a photomicrograph showing a cam shaft—cam piece joint interface produced according to the present invention.

Figure 3:
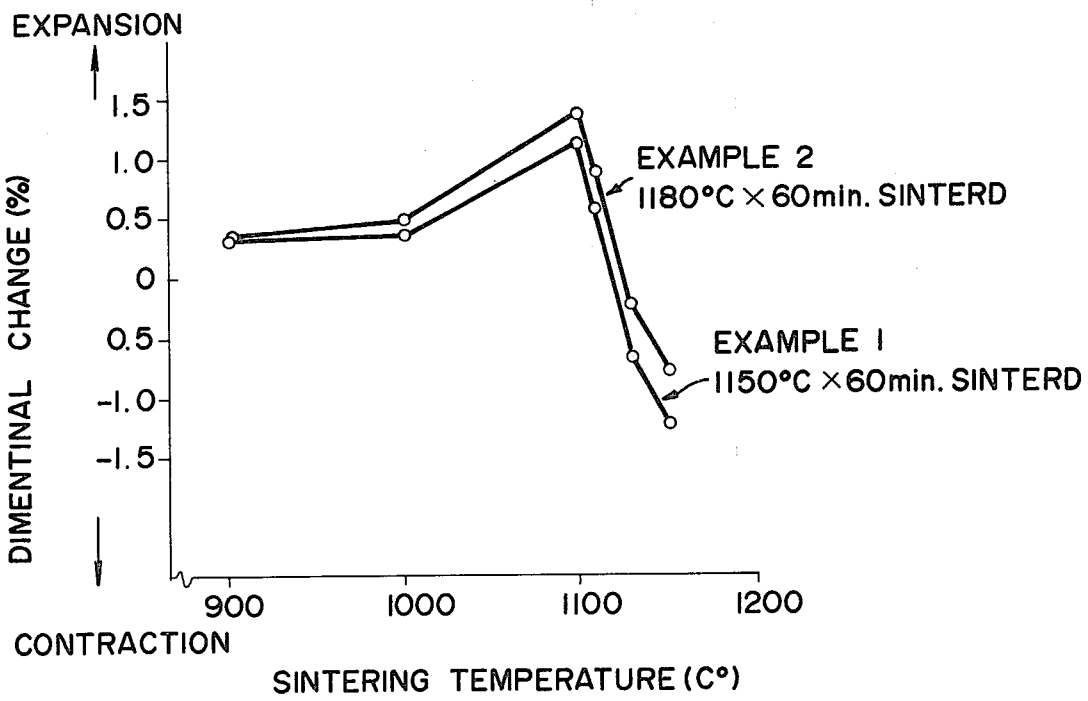

FIG. 3 graphically illustrates the relation between sintering temperature and dimensional changes (%) of the cam pieces of Examples 1 and 2 of the present invention.

DETAILED DESCRIPTION

The substance of the present invention lies in a method of joining a shaft to its fitting member, characterized in that a fitting member is made as a molded product from a wear-resistant sinterable iron base alloy powder which yields a liquid phase when sintered, or of this powder which has been preliminarily sintered at a temperature not yielding a liquid phase; the fitting member is assembled to a shaft which has been separately fabricated; and then the assembly is sintered at a temperature causing a precipitation of liquid phase.

Preferred techniques according to the invention will be described for joining a cam shaft—cam piece assembly.

In the present invention, the quality of the shaft is not particularly critical, but for the purpose of readily obtaining a metallic bond between the shaft and its fitting member, materials such as JIS (Japanese Industrial Standard), STKM 13-17 (Carbon Steel Tubes for Machine Structural Purpose), SCM 40 (Chromium Molybdenum Steels) and S55C (Carbon Steel for Machine Structural use) are preferred. The shaft can be either solid or hollow.

As the wear-resistant iron base sintered alloy, the composition C, 0.5-2.0%; Mo, 3.0-18.0%; P, 0.8-3.0%; B, 0.02-0.3%; the balance being Fe, or this composition and Cu, 0.1-10.0% can be used. Further, this composition and a Co-addition of less than 5% as well as the Cu-addition or a composition of an Fe-W-Cr system or an Fe-W-Cr-Mo system can be employed. The wear-resistant iron base sintered alloy which can meet the requirements in this invention is one which produces a liquid phase and shrinks to the extent of producing a sufficiently strong metallic bond during sintering.

The present invention involves a step of preliminarily sintering the fitting member at a temperature not yielding a liquid phase, and in which the molding pressure is desirably in the range of 3-7 t/cm$^2$. If the molding pressure is below 3 t/cm$^2$, the pre-sintered product will not be strong enough, causing an inconvenience in assembling, affecting the strength of the sintered product, making the dimensions of the sintered product inaccurate and accordingly deteriorating the workability. When the molding pressure exceeds 7 t/cm$^2$, the metallic bond between shaft and its fitting member will be poor.

The pre-sintering temperature is desirably in the range of 850°-1000° C. The fitting member, which is assembled to the shaft by appropriate technique such as pressure-fitting, should be strong enough not to be deformed when assembled.

For this reason, a pre-sintering temperature higher than 850° C. is desirable. When this temperature exceeds 1000° C., a heavy dimensional change occurs causing a wide variance in the product. Thus the pre-sintering temperature is desirably below 1000° C.

When the fitting member is a compressed molded product of metal powder, the object of the present invention can be attained, if special care is taken not to cause cracking during assembling.

Pressure-fitting or clearance-fitting are appropriate techniques for assembling the shaft to the fitting member. The important thing is to fix together the shaft and its fitting member immovably. In the case of pressure-fitting, an ample interference and a firm fixture will give a strong metallic bond as the fitting member shrinks in sintering. In the case of a compressed molded product, pressure-fitting cannot be used and the assembling is done by clearance-fitting. The sintering after assembling is done at 1125°-1200° C. in a reducing atmosphere. The lower temperature limit is set at 1125° C., because shrinking does not take place below this temperature; and the sintered product becomes molten and cannot maintain its form when heated to a temperature higher than 1200° C. The sintering temperature can vary slightly depending on the molding pressure of the presintered product and/or on the sintering time.

Examples of the present invention are illustrated below.

EXAMPLE 1

A composition by weight of C 1% (graphite powder of 2-3$\mu$ in particle diameter), Cu 2% (electrolytic powder of 20$\mu$ particle diameter), P 1.2% (ferroalloy of −250 mesh), B 0.06% and Mo 12% (ferroalloy of −250 mesh), the balance being Fe, was blended for 30 minutes in a V-type mixer. With zinc stearate 0.3% added as a mold lubricant, the obtained blend was metalmolded into the shape of a cam piece of a density of 6.5 g/cm$^3$, and heated at 980° C. in a decomposed ammonia gas for 30 minutes to obtain a pre-sintered product. The cam piece thus obtained has a hardness of Hv 90–110 and a compressive strength of 19–22 kg/mm$^2$, has high dimensional accuracy, the error in $\phi$ 28 (diameter of 28 mm) being $\pm 15\mu$. This piece was press-fitted to the cam shaft and was sintered at 1150° C. for 60 minutes in a decomposed ammonia gas of dew point −20° C. In this process the cam piece, as illustrated by FIG. 3(1), first expanded and then contracted; up to 1100° C. it had expanded to about $\phi$ 28.30 (diameter of 28.30 mm), which was larger than the size of $\phi$ 28.00 during assembling. Therefore during sintering of the piece on the shaft, care was taken to prevent the nose direction of the cam piece from changing during the expansion. The results of material evaluation tests show that the wear resistance required for the cam member is obtained by sintering at conditions of over 1130° C.×60 minutes. Therefore if the sintering is allowed to progress up to this temperature the cam piece hardens, a cam piece contraction of about 1% is caused by emergence of liquid phase between 1125° and 1155° C. and a metallic bond due to diffusion takes place at the cam piece—shaft interface. A section view of the cam shaft—piece joint is illustrated in FIG. 1 and the joined state in FIG. 2.

From FIG. 2 it is seen that the cam shaft and the cam piece have been metallurgically fused. The joint tested an axial shear stress at about 18 kg/mm$^2$ which is strong enough for service.

EXAMPLE 2

In Example 2, the cam piece composition of Example 1 was used except the Mo content was changed to 8%, and Co 5% was added. The cam piece was similarly pre-sintered, and after assembling, sintering at 1180° C.×60 minutes was done, during which there was expansion-contraction of the cam piece as illustrated in FIG. 3(2). The joint strength was about 18 kg/mm$^2$, just as with the joint of Example 1.

The above examples disclose the joining of a cam shaft and cam piece, but it goes without saying that the present invention is not limited to these examples. Depending on the material quality, shape and size of the fitting member, the above conditions can change more or less.

The joining method according to the present invention is simple as compared with conventional methods; effective for cost reduction; and, as is evident from the examples, it is a highly reliable method giving a joint strength high enough for practical service with little variance.

What is claimed is:

1. A method of joining a shaft to a fitting member comprising, molding a fitting member from wear-resistant iron base sinterable alloy powder which yields a liquid phase and shrinks during sintering; assembling said fitting member to a separately produced shaft; and then sintering the assembly of fitting member and shaft at a temperature to cause the fitting member to shrink and to yield a liquid phase of the fitting member to metallurgically bond the fitting member to the shaft.

2. The method of claim 1, wherein the shaft is a cam shaft and the fitting member is a cam piece.

3. The method of claim 1 or 2, wherein said wear-resistant sinterable iron-base alloy which yields a liquid phase and shrinks during sintering has the composition by weight of C, 0.5–2.0%; Mo, 3.0–18.0%; P, 0.8–3.0%; and B, 0.02–0.3%; the balance being Fe.

4. The method of claim 2, wherein the steps of molding comprises molding at a pressure in the range of 3–7 t/cm$^2$.

5. The method of claim 2, wherein the fitting member is assembled to the shaft as a slight clearance fit on the shaft.

6. The method of claim 2, wherein the sintering is done at 1125°–1200° C. in a reducing atmosphere.

7. The method of claim 2, wherein said wear-resistant iron base alloy powder which yields a liquid phase and shrinks in sintering is molded at a pressure of 3–7 t/cm$^2$; the fitting member in the form of this molded product is assembled to the separately produced shaft; and then the shaft and fitting member assembly is sintered in a reducing atmosphere at 1125°–1200° C.

8. A method of joining a shaft to a fitting member, comprising forming a wear-resistant iron base sinterable alloy powder product which yields a liquid phase and shrinks in sintering; pre-sintering the product at a temperature not yielding a liquid phase to form a fitting member; assembling the fitting member to a separately produced shaft; and thereafter sintering the assembly of shaft and fitting member at a temperature higher than the liquid phase—yielding point of the fitting member to cause the member to shrink and to yield a liquid phase to bond the assembly together.

9. The method of claim 8, wherein the shaft is a cam shaft and the fitting member is a cam piece.

10. The method of claim 8 or 9, wherein said wear-resistant iron base sinterable alloy which yields a liquid phase in sintering and shrinks has the composition of C, 0.5–2.0%; Mo, 3.0–18.0%; P, 0.8–3.0%; and B, 0.02–0.3%; the balance being Fe.

11. The method of claim 9, wherein the pre-sintering is done at a molding pressure 3–7 t/cm$^2$ and a temperature 850°–1000° C.

12. The method of claim 9, wherein the fitting member is assembled to the shaft by a technique selected from the group consisting of pressure-fitting or clearance-fitting.

13. The method of claim 9, wherein the sintering is done at 1125°–1200° C. in a reducing atmosphere.

14. The method of claim 9, wherein the wear-resistant iron base alloy powder which yields a liquid phase and shrinks in sintering is pre-sintered at a molding pressure 3–7 t/cm$^2$ and a temperature 850°–1000° C.; the fitting member thus produced is assembled by clearance-fitting to the separately produced shaft; and then the assembly of shaft and fitting member is sintered at 1125°–1200° C. in a reducing atmosphere.

* * * * *

REEXAMINATION CERTIFICATE (1138th)

United States Patent [19]

Takahashi et al.

[11] B1 4,236,923

[45] Certificate Issued Oct. 10, 1989

[54] METHOD OF METALLURGICALLY JOINING A FITTING TO A SHAFT

[75] Inventors: Akio Takahashi, Toyota; Chiaki Tsumuki, Aichi; Hitoshi Nakamura, Toyota, all of Japan

[73] Assignee: Toyota Jidosha Kogyo Kabushiki Kaisha, Aichi, Japan

Reexamination Request:
No. 90/000,572, Jun. 6, 1984

Reexamination Certificate for:

| | |
|---|---|
| Patent No.: | **4,236,923** |
| Issued: | **Dec. 2, 1980** |
| Appl. No.: | **960,622** |
| Filed: | **Nov. 14, 1978** |

[30] Foreign Application Priority Data

Jan. 31, 1978 [JP] Japan ..... 53-9527

[51] Int. Cl.[4] ..... B22F 7/00

[52] U.S. Cl. ..... 419/6; 419/8; 419/47; 419/48

[58] Field of Search ..... 419/8, 12, 14, 38, 39, 419/47; 29/447, 525; 74/567

[56] References Cited

U.S. PATENT DOCUMENTS

| | | | |
|---|---|---|---|
| 3,725,994 | 4/1973 | Wechsler | 29/447 |
| 3,977,838 | 8/1976 | Hashimoto et al. | 29/182.5 |
| 4,096,615 | 6/1978 | Cross | 29/447 |
| 4,137,106 | 1/1979 | Doi et al. | 148/126 |

FOREIGN PATENT DOCUMENTS

| | | |
|---|---|---|
| 975193 | of 0000 | Canada . |
| 11606 | of 1970 | Japan . |
| 157210 | of 1975 | Japan . |
| 51-60609 | of 1976 | Japan . |
| 51-84711 | of 1976 | Japan . |
| 118546 | of 1976 | Japan . |
| 628679 | of 0000 | United Kingdom . |

OTHER PUBLICATIONS

"Sintered Iron and Sintered Steel", by Kieffer and Hotop, 1948.

"Latest Development in Powder Metallurgy", by Friedrich Eisenkolb, 1955.

Lenel, Powder Metallurgy Principles and Applications, Metal Powder Industries Federation, Princeton, N.J. (1980) pp. 219–220.

"Handbook of Metals", 12.4 entitled Sintered Materials, with translation, published Jun. 25, 1971 by Maruzen Co., Ltd. of Tokyo, Japan (Ed.: Japan Metallic Society).

*Primary Examiner*—Stephen J. Lechert, Jr.

[57] ABSTRACT

Method of obtaining a metallurgically firm joint between a shaft and its fitting member by assembling on the shaft a fitting member molded of a wear-resistant iron base sinterable alloy which yields a liquid phase in sintering, or by preliminarily sintering such an alloy at a temperature not yielding a liquid phase, and thereafter sintering the assembly at a temperature causing a precipitation of liquid phase, whereby the liquid phase of the fitting member is caused to diffuse and penetrate into the shaft with shrinkage of the sintered part.

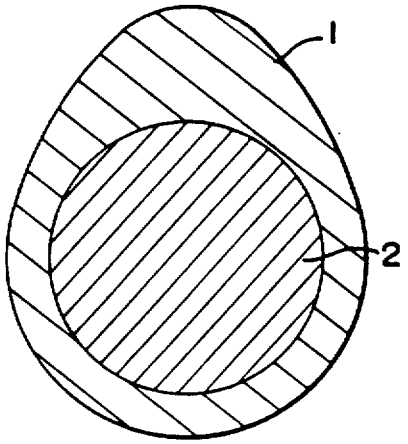

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–14 are cancelled.

* * * * *